US006156026A

United States Patent [19]

Rondeau

[11] Patent Number: 6,156,026

[45] Date of Patent: Dec. 5, 2000

[54] POOL FILLING NOZZLE WITH SUPPORTING BRACKET

[76] Inventor: André Rondeau, 613, rue Du Berger, Deux-Montagnes P.Q., Canada, J7R 6G8

[21] Appl. No.: 09/410,074

[22] Filed: Oct. 1, 1999

[51] Int. Cl.[7] ..... E04H 4/00

[52] U.S. Cl. ..... 604/507; 239/283; 248/231.41

[58] Field of Search ..... 4/496, 507, 508, 4/567, 568, 570; 239/282, 283; 248/228.3, 231.41

[56] References Cited

U.S. PATENT DOCUMENTS

| | | | |
|---|---|---|---|
| 2,605,136 | 7/1952 | Kline et al. | 239/282 |
| 4,141,524 | 2/1979 | Corvese, Jr. | 248/231.41 X |
| 4,195,369 | 4/1980 | Lesick | 239/283 X |
| 4,586,532 | 5/1986 | Tsolkas | 4/508 X |
| 4,735,230 | 4/1988 | Detloff | 4/508 X |
| 5,203,038 | 4/1993 | Gibbs . | |

*Primary Examiner*—Robert M. Fetsuga

[57] ABSTRACT

A pool filling nozzle is provided with a supporting bracket and a clamp to secure the nozzle to the top of a swimming pool wall or to a pool accessory such as a ladder step, a platform or a diving board. The bracket is L-shaped defining a top horizontal arm on which the nozzle is secured and a vertical arm provided with a central slot. The clamp is also L-shaped and defines a vertical arm in slidable guided contact with the vertical arm of the bracket and a horizontal arm extending substantially parallel and in the same direction to the horizontal arm of the bracket. A tightened releasably tightens the two vertical arms in adjusted position to adjust the spacing between the two horizontal arms. The clamp is reversible. Thus, the nozzle can be clamped to a swimming pool parts of a large range of thickness. The bracket and the clamp are preferably made of thin flexible material so that the two horizontal arms can be opened to easily clip the bracket to the pool part.

13 Claims, 2 Drawing Sheets

POOL FILLING NOZZLE WITH SUPPORTING BRACKET

FIELD OF THE INVENTION

The present invention relates a nozzle for filling pools such as a spa or a swimming pool by attachment to the male end of a garden hose and more particularly to the combination of such a nozzle with a supporting bracket to support the nozzle on a pool structure or pool accessory.

BACKGROUND OF THE INVENTION

U.S. Pat. No. 1,476,810 dated Dec. 11, 1923 entitled NOZZLE to J. Gilsenan describes a nozzle with a bracket to mount the nozzle on the top edge of a swimming pool wall or the like. However, the mounting bracket does not securely clamp the nozzle in position and is not adapted to clamp the nozzle to water pool top ledges of various thickness. Moreover, the nozzle of the patent is made of a number of components which must be assembled, a time consuming operation.

OBJECTS OF THE INVENTION

The main object of the present invention is to provide a pool filling nozzle with a supporting bracket combined with a clamping member to form a U-shaped member, the spacing between the two legs of the U-shaped member being adjustable.

Another object of the present invention is to provide the combination above described wherein the bracket and clamping members are both made of thin flexible materials so that the horizontal legs can be opened up to enable quick clipping of the nozzle in position on a pool part.

Another object of the present invention is to provide the above noted combination which can be molded to decrease the number of components forming the device of the invention.

SUMMARY OF THE INVENTION

The invention is directed to a pool filling nozzle with a supporting bracket for supporting the nozzle on a pool structure or accessory of the type having a generally horizontal top face, a substantially vertical face meeting with said top face and facing said pool and an underface merging with said vertical face, said nozzle having an outlet end and an inlet end, said bracket having an L-shape defining a first and a second arm adapted to respectively engage said top face and said vertical face, a connector securing said nozzle to said first arm substantially parallel thereto with its outlet end disposed above said second arm, an L-shape clamping member having a first arm in slidable guided contact with said second arm of said bracket and a second arm extending substantially parallel to the first arm of said bracket and a tightener for releasably tightening said first arm of said clamping member to said second arm of said bracket to adjust the spacing between said first arm of said bracket and said second arm of said clamping member.

Preferably, said second arm of said bracket has a slot extending away from said first arm of said bracket and said tightener includes a nut fixed to said first arm of said clamping member and a set screw extending through said slot and screwed within said nut.

Preferably, said second arm of said bracket has parallel side edges and further including guide flanges carried by and normal to said first arm of said clamping member and in slidable contact with said side edges to maintain said second arm of said clamping member substantially parallel to said first arm of said bracket.

Preferably, said clamping member is reversibly mounted on said bracket with said first arm of said clamping member extending either towards or away from said first arm of said bracket to increase the range between the minimum and maximum spacing between the first arm of said bracket and the second arm of said clamping member.

Preferably said bracket and/or said clamping member is formed of thin flexible material.

Preferably, the inlet end of said nozzle forms a female inwardly threaded coupling portion in which can be screwed the male externally threaded end of a garden hose and said tubular nozzle and said connector and said bracket are moulded in one piece.

BRIEF DESCRIPTION OF THE DRAWINGS

In the annexed drawings, like reference characters indicate like elements throughout.

DETAILED DESCRIPTION OF THE PREFERRED EMBODIMENT

Figure 2:
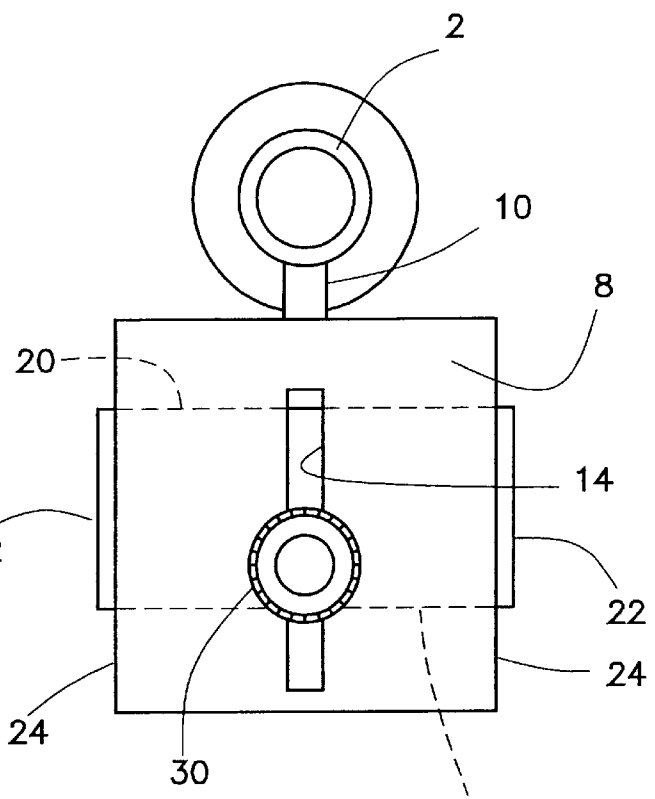
FIG. 2 is a front elevation of the device.

In accordance with the invention, a tubular nozzle 2 is supported by a bracket 4, which is of L-shape when viewed sideways defining a horizontal arm 6 and a vertical arm 8. The nozzle 2 is supported substantially parallel to the horizontal arm 6 by a connector web 10.

Nozzle 2 and bracket 4 and connector web 10 are moulded in one piece from a plastic material such as polyvinyl chloride. Nozzle 2 has a female inwardly threaded coupling portion 12 at its inlet end in which can be screwed the male externally threaded end of a garden hose. Outlet and 13 of nozzle 2 in above vertical arm 8.

A slot 14 is made in the vertical arm 8 at the center thereof and extends substantially in a direction normal to the plane of horizontal arm 6.

An L-shaped clamping member 16 is provided which defines a vertical arm 18 and a horizontal arm 20. Vertical arm 18 has side guide flanges 22 which overlap and are in sliding contact with the parallel slide edges 24 of vertical arm 8 of bracket 4.

A nut 26 is secured to the vertical arm 18 of clamping member 16 opposite slot 14. A set screw 28 having an operating knob 30 on the outside of vertical arm 8 of bracket 4 freely extends through the slot 14 and is screwed within the nut 26.

Figure 3:
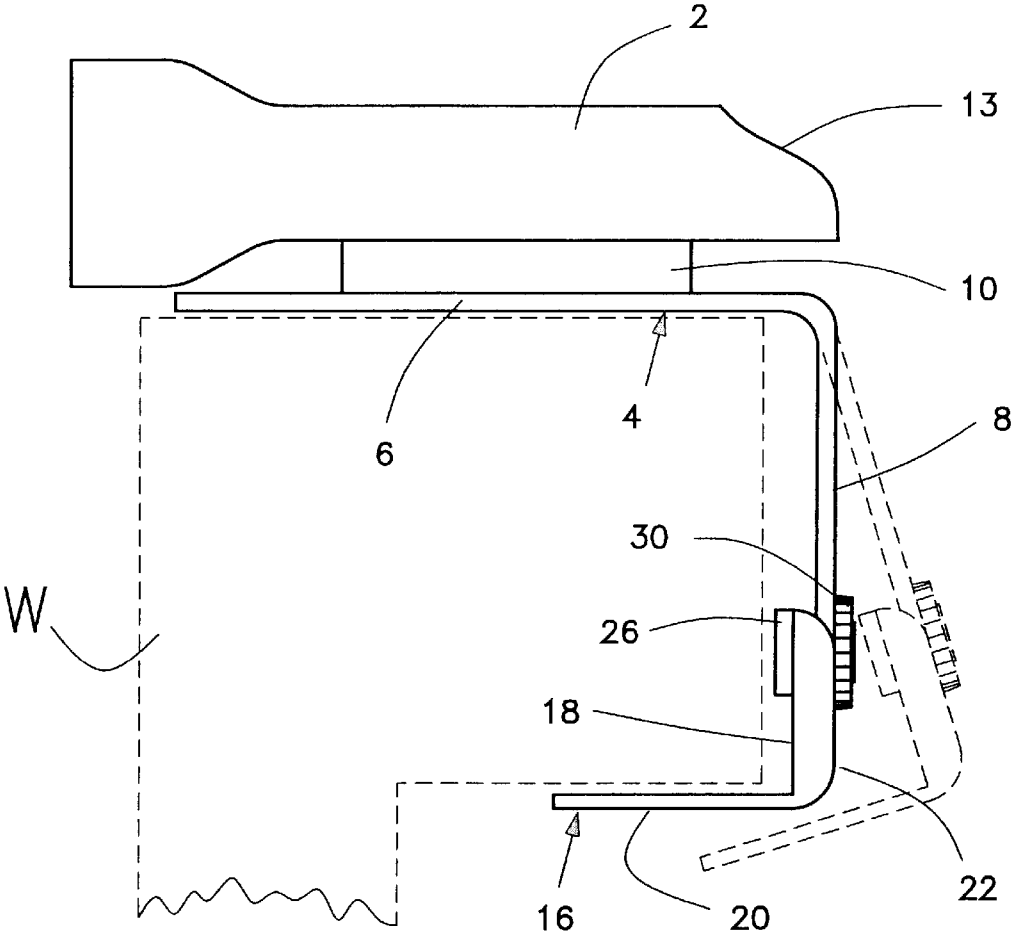
FIG. 3 is a side elevation showing the clamping member in reverse position.

Both the bracket 4 and the clamping member 16 are made of thin flexible material so that the two horizontal arms 6 and 20 can be opened up as shown in dotted lines in FIG. 3.

Figure 1:
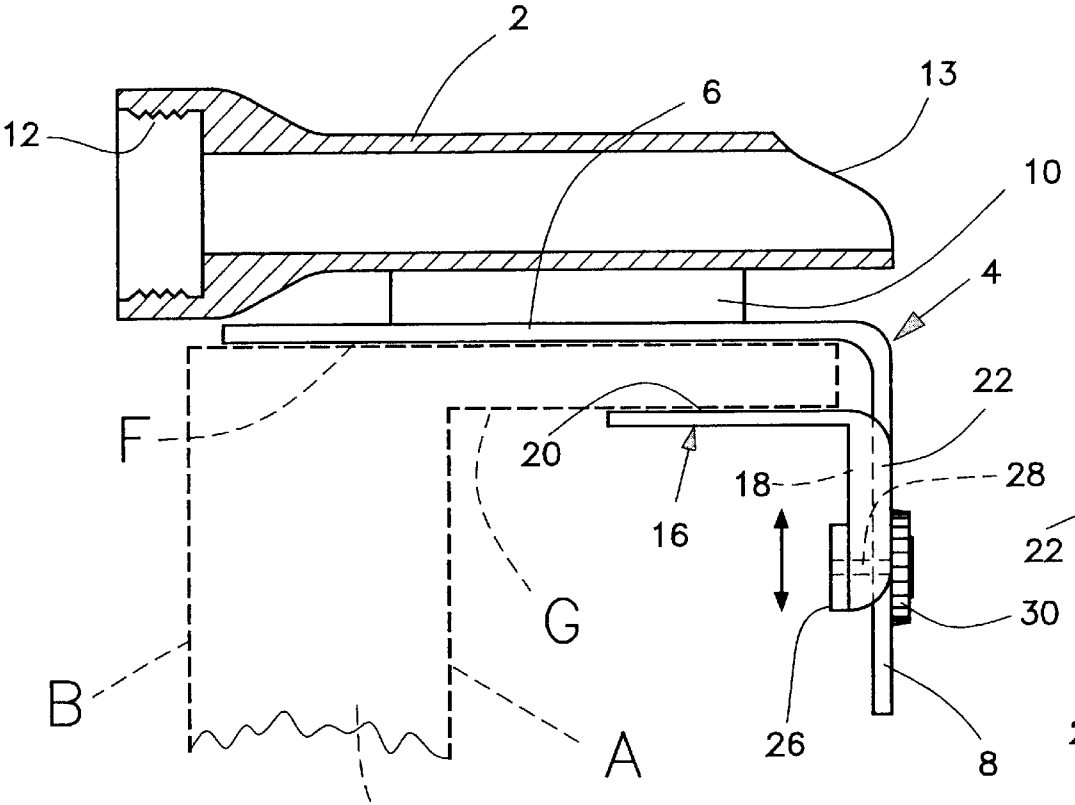
FIG. 1 is a partial vertical section and an elevation of the device of the invention, said Figure being taken along line 1—1 of FIG. 2.
Figure 4:
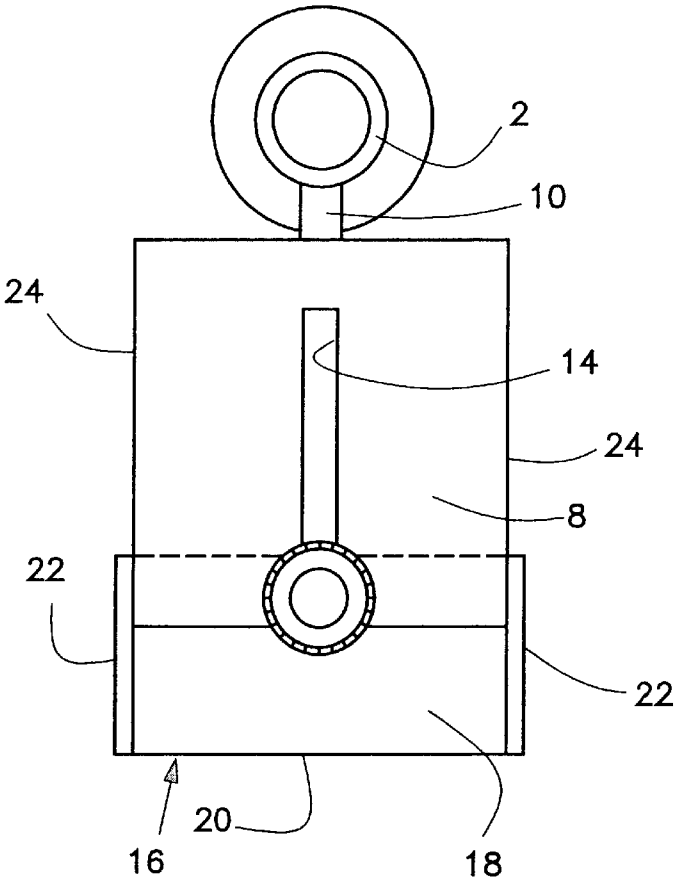
FIG. 4 is a front elevation of the device in the position of FIG. 3.

Comparison of FIGS. 1 and 3 clearly shows that the clamping member 16 can be attached to the bracket 4 in two reverse positions, that is with the horizontal arm 20 of clamping member 16 uppermost so that the spacing between the two horizontal arms 6 and 20 can be brought to a minimum or with the horizontal arm 20 of the clamping member 16 in the lowermost position as shown in FIG. 3 so that the spacing between the two horizontal arms can be adjusted to a maximum limit position.

Thus, the bracket 4 combined with the clamping member 16 can be attached to for instance the top ledge of a pool side wall W, said top portion having an inside face A, an outside face B and forming a top flange F which extends inwardly within the pool and protruding from the inside face A to form a top top flange underface G.

Horizontal arm 20 is maintained substantially parallel to horizontal arm 6 in both its upright and inverted positions because flanges 22 contact the side edges 24 of the horizontal arm 6 in both said positions.

Since bracket 4 and clamping member 16, are flexible, the device can be once adjusted to fit the thickness of a specific top flange F, can be simply opened up to be clipped to said flange as shown in dotted line in FIG. 3.

Obviously, the combined bracket and clamping member can be clipped to various pool accessories such as to the step of a ladder, to a diving board or to a platform.

I claim:

1. A pool filling nozzle with a supporting bracket for supporting the nozzle on a pool structure or accessory of the type having a generally horizontal top face, a substantially vertical face meeting with said top face and facing said pool and an underface merging with said vertical face, said nozzle having an outlet end and an inlet end, said bracket having an L-shape defining a first and a second arm adapted to respectively engage said top face and said vertical face, a connector securing said nozzle to said first arm substantially parallel thereto with its outlet end disposed above said second arm, an L-shape clamping member having a first arm in slidable guided contact with said second arm of said bracket and a second arm extending substantially parallel to the first arm of said bracket, and a tightener for releasably tightening said first arm of said clamping member to said second arm of said bracket to adjust the spacing between said first arm of said bracket and said second arm of said clamping member.

2. A pool filling nozzle with a supporting bracket as defined in claim 1, wherein said clamping member is reversibly mounted on said bracket first arm to increase the range between the minimum and maximum spacing between said first arm of said bracket and said second arm of said clamping member.

3. A pool filling nozzle with a supporting bracket as defined in claim 1, wherein said second arm of said bracket has a slot extending away from said first arm of said bracket and said tightener includes a nut fixed to said first arm of said clamping member and a set screw extending through said slot and screwed within said nut.

4. A pool filling nozzle with a supporting bracket as defined in claim 3, wherein said second arm of said bracket has parallel side edges and further including guide flanges carried by and normal to said first arm of said clamping member and in slidable contact with said side edges to maintain said second arm of said clamping member substantially parallel to said first arm of said bracket.

5. A pool filling nozzle with a supporting bracket as defined in claim 4, wherein said clamping member is reversibly mounted on said bracket member with said first arm of said clamping member extending either towards or away from said first arm of said bracket member to increase the range between the minimum and maximum spacing between said first arm of said bracket member and said second arm of said clamping member.

6. A pool filling nozzle with a supporting bracket as defined in claim 5, wherein both said bracket and said clamping member are formed of thin flexible material.

7. A pool filling nozzle with a supporting bracket as defined in claim 6, wherein said inlet end of said tubular nozzle forms a female inwardly threaded coupling portion in which can be screwed the male externally threaded end of a garden hose and wherein said tubular, said connector and said bracket are molded in one piece.

8. A pool filling nozzle with a supporting bracket as defined in claim 7, wherein said clamping member is reversibly mounted on said bracket with said first arm of said clamping member extending either towards or away from said first arm of said bracket to increase the range between the minimum and maximum spacing between the first arm of said bracket and the second arm of said clamping member.

9. A pool filling nozzle with a supporting bracket as defined in claim 3, wherein said clamping member is reversibly mounted on said bracket with said first arm of said clamping member extending either towards or away from said first arm of said bracket to increase the range between the minimum and maximum spacing between the first arm of said bracket and the second arm of said clamping member.

10. A pool filling nozzle with a supporting bracket as defined in claim 1, wherein said bracket is formed of thin flexible material.

11. A pool filling nozzle with a supporting bracket as defined in claim 1, wherein said clamping member is formed of thin flexible material.

12. A pool filling nozzle with a supporting bracket as defined in claim 1, wherein both said bracket and said clamping member are formed of thin flexible material.

13. A pool filling nozzle with a supporting bracket as defined in claim 1, wherein said inlet end forms a female inwardly threaded coupling portion in which can be screwed the male externally threaded end of a garden hose and wherein said tubular nozzle and said connector and said bracket are molded in one piece.

* * * * *